US007914322B2

(12) United States Patent
Lin

(10) Patent No.: US 7,914,322 B2
(45) Date of Patent: Mar. 29, 2011

(54) CABLE CONNECTOR AND ASSEMBLY THEREOF WITH IMPROVED HOUSING STRUCTURE

(76) Inventor: Pei-Yu Lin, KunShan (CN)

( * ) Notice: Subject to any disclaimer, the term of this patent is extended or adjusted under 35 U.S.C. 154(b) by 0 days.

(21) Appl. No.: 12/485,497

(22) Filed: Jun. 16, 2009

(65) Prior Publication Data

US 2010/0216342 A1 Aug. 26, 2010

(30) Foreign Application Priority Data

Feb. 23, 2009 (CN) ..... 2009 2 0067981 U
Mar. 9, 2009 (CN) ..... 2009 2 0068599 U
Mar. 20, 2009 (CN) ..... 2009 2 0009258 U

(51) Int. Cl.
*H01R 12/24* (2006.01)

(52) U.S. Cl. ..... 439/497; 439/492; 439/874

(58) Field of Classification Search ..... 439/497, 439/492, 499, 874
See application file for complete search history.

(56) References Cited

U.S. PATENT DOCUMENTS 6,364,702 B1 4/2002 Mochizuki et al.
6,685,495 B1 * 2/2004 Ko ..... 439/353
6,705,893 B1 * 3/2004 Ko ..... 439/607.56
6,843,679 B2 1/2005 Kuo et al.
7,361,049 B2 * 4/2008 Nagata et al. ..... 439/497
7,377,803 B2 * 5/2008 Matsuoka ..... 439/497
2006/0134969 A1 6/2006 Takaku et al.

* cited by examiner

*Primary Examiner* — Hien Vu
(74) *Attorney, Agent, or Firm* — Sughrue Mion, PLLC

(57) ABSTRACT

A cable connector includes an insulative housing defining a mounting chamber, a bottom surface positioned at the bottom of mounting chamber and a number of longitudinal ribs formed on the bottom surface while extending upwardly beyond the bottom surface. Multiple contacts are fixed in the insulative housing and include a number of soldering tails under an arrangement that each adjacent two soldering tails are separated by one of the ribs. A space between adjacent edges of the adjacent two soldering tails is much bigger than a width of the corresponding rib which is located between the adjacent two soldering tails for preventing short circuit of the soldering tails.

16 Claims, 15 Drawing Sheets

CABLE CONNECTOR AND ASSEMBLY THEREOF WITH IMPROVED HOUSING STRUCTURE

BACKGROUND OF THE INVENTION

1. Field of the Invention

The present invention relates a cable connector and assembly thereof, and more particularly to a cable connector and assembly thereof with low profile and improved housing structure.

2. Description of Related Art

Low Voltage Differential Signaling (LVDS) promoted by National Semiconductor Corp. is now one of the typical high-rate serial transmission techniques for video signals. LVDS stands are mainly used in input interfaces for liquid crystal panels (LCD) installed in notebook computers. In LVDS system, data is transmitted in the form of low amplitude differential signals.

Accordingly, a LVDS connector assembly includes a LVDS cable connector and a female electrical connector mounted on a PCB for mating with the LVDS cable connector. The LVDS cable connector normally includes an insulative housing defining a number of contact-receiving passageways, a plurality of contacts received in such passageways, a metal shell enclosing the insulative housing and a number of cables electrically connected with the contacts. The contacts include contact portions for mating with the female electrical connector and soldering portions for being soldered with the corresponding cables. However, with rapid development of the LVDS connector assembly, the profiles of the LVDS cable connector and the female electrical connector are becoming smaller and smaller. Take the LVDS cable connector for example, the width of each passageway is relative narrow. With insertion of the contacts into the passageways, a space between each adjacent two soldering portions is very small. In soldering process, soldering tin may easily mix the adjacent two soldering portions, which may result in short circuit of such adjacent two contacts.

Besides, normally, the female electrical connector employs a unitary metal shield stamped from a metal sheet for EMI protection. However, such unitary metal shield is complex and may increase manufacturing cost. However, if the metal shield is separated by individual ones, a new problem of how to easily assemble such individual metal shields may puzzle those of ordinary skill in the art.

Hence, it is desired to have a cable connector and assembly thereof with improved housing structure, and a female electrical connector with improved separated metal shields in order to solve the problems above.

BRIEF SUMMARY OF THE INVENTION

A cable connector assembly includes a cable connector and a wire module fixed in the cable connector. The cable connector includes an insulative housing and a plurality of contacts fixed in the insulative housing. The insulative housing includes a rear base portion, a mating portion extending forwardly from the base portion and a plurality of passageways extending through the base portion and the mating portion. The base portion defines a mounting chamber to form a bottom surface positioned at the bottom of mounting chamber. A plurality of longitudinal ribs are formed on the bottom surface and extend upwardly beyond the bottom surface. Each contact is received in the passageway and includes a contact portion disposed on the mating portion and a soldering tail disposed on the base portion under a condition that each adjacent two soldering tails are separated by one of the ribs along a transverse direction. The wire module includes a grounding bar received in the mounting chamber and a plurality of wires fixed in the grounding bar. Each wire includes a central conductive core protruding forwardly beyond the grounding bar to electrically connect with the soldering tails for signal transmission. The longitudinal ribs are provided for preventing short circuit of the soldering tails when the soldering tails are soldered with the corresponding conductive cores. A space between adjacent edges of the adjacent two soldering tails is much bigger than a width of the corresponding rib which is located between the adjacent two soldering tails so that short circuit of the adjacent two contacts can be avoided.

A female electrical connector for being mounted on a PCB includes an insulative housing, a plurality of contacts retained in the insulative housing and a pair of upper and lower metal shells locking with each other to enclose the insulative housing. The insulative housing includes a base and a pair of extending arms protruding from the base with a receiving space formed between the extending arms. The base has an upper plate, a lower plate and a slit formed between the upper and the lower plates. The slit is in communication with the receiving space. An inner side of the upper plate defines a plurality of passageways opposite to the slit and further extending backwardly through a rear surface of the base. Each contact is retained in the passageway and comprises a retaining portion fixed in the base, a mating portion exposed to the slit and a soldering portion extending backwardly beyond the rear surface of the base. The upper metal shield includes an upper main portion attached to the base and a pair of upper side portions located at lateral sides of the base. Each upper side portion comprises a L-shaped bending portion which includes a vertical portion and a horizontal portion under a condition that the vertical portion defines an engaging hole extending along a front-to-rear direction. The lower metal shield includes a lower main portion and a pair of engaging portions bending upwardly from lateral sides of the lower main portion which is inserted into the slit and located at the bottom of the receiving space. Each engaging portion includes a tab extending outwardly. Thee engaging portions are attached to out walls of the corresponding extending arms and the bending portions further lap over the engaging portions. A length of the engaging hole along the front-to-rear direction is much larger that that of the tab so that the tab can be easily inserted into the engaging hole for locking the upper and the lower metal shields.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 6:
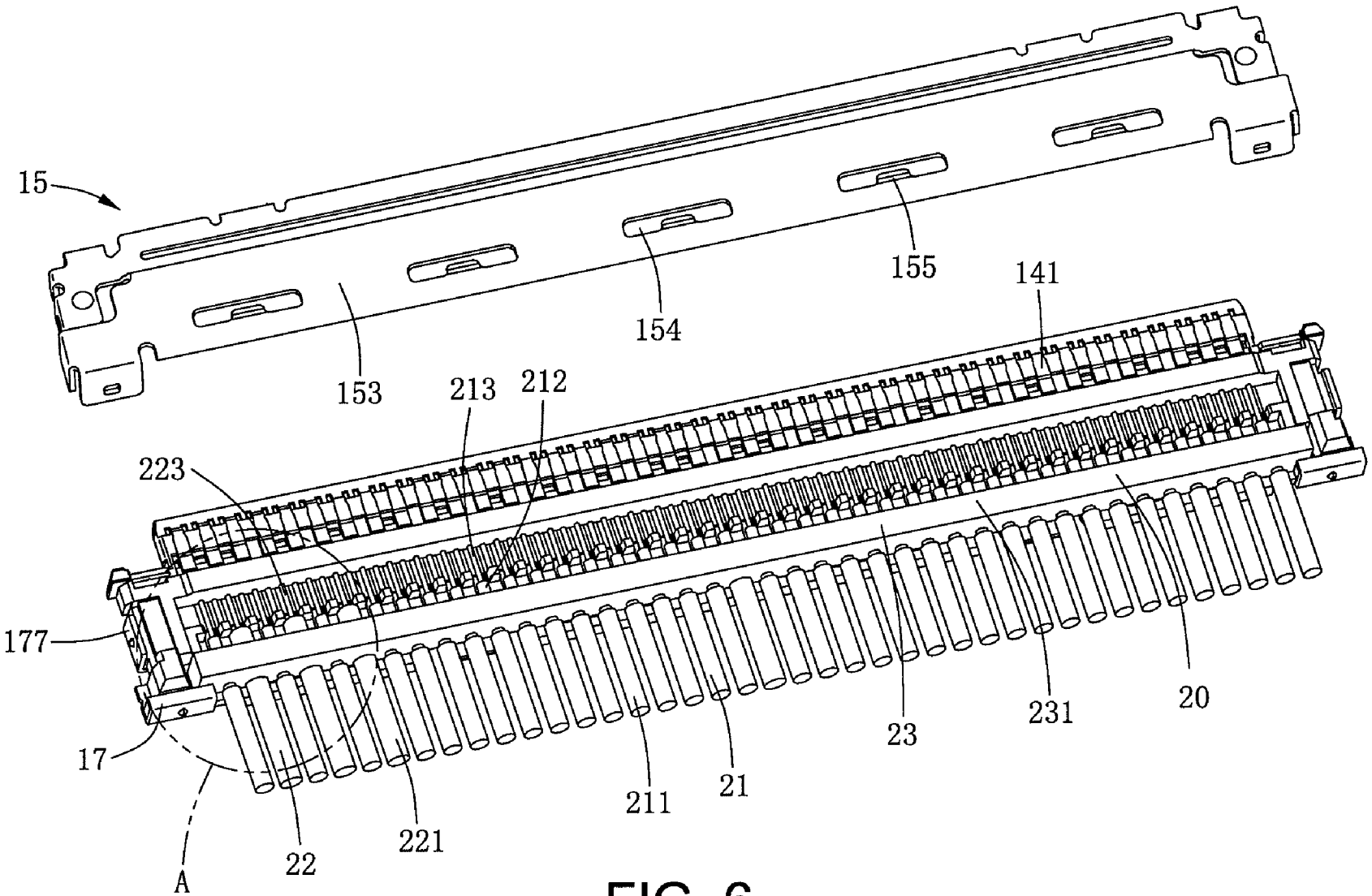
FIG. 6 is a part exploded view of the cable connector assembly with an upper metal shell detached therefrom.
Figure 7:
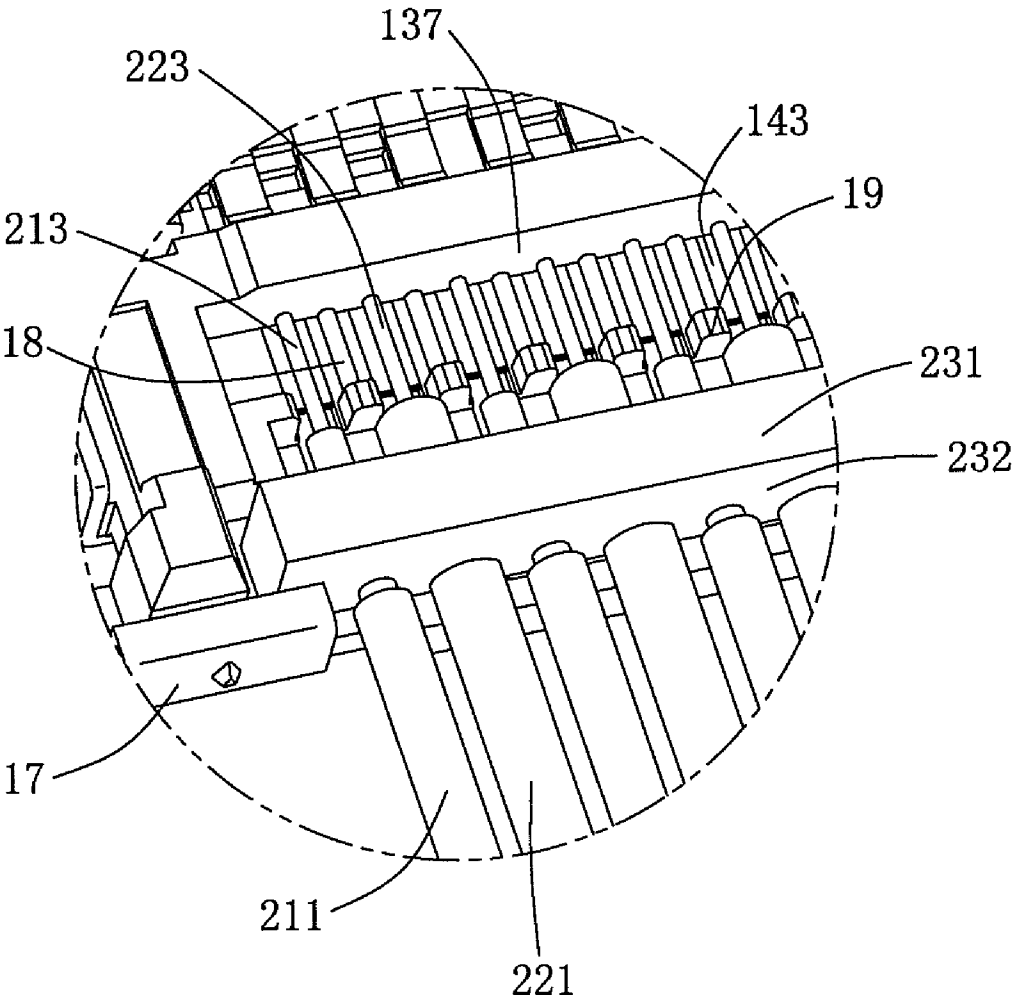
FIG. 7 is an enlarged view of portion A shown in FIG. 6.
Figure 8:
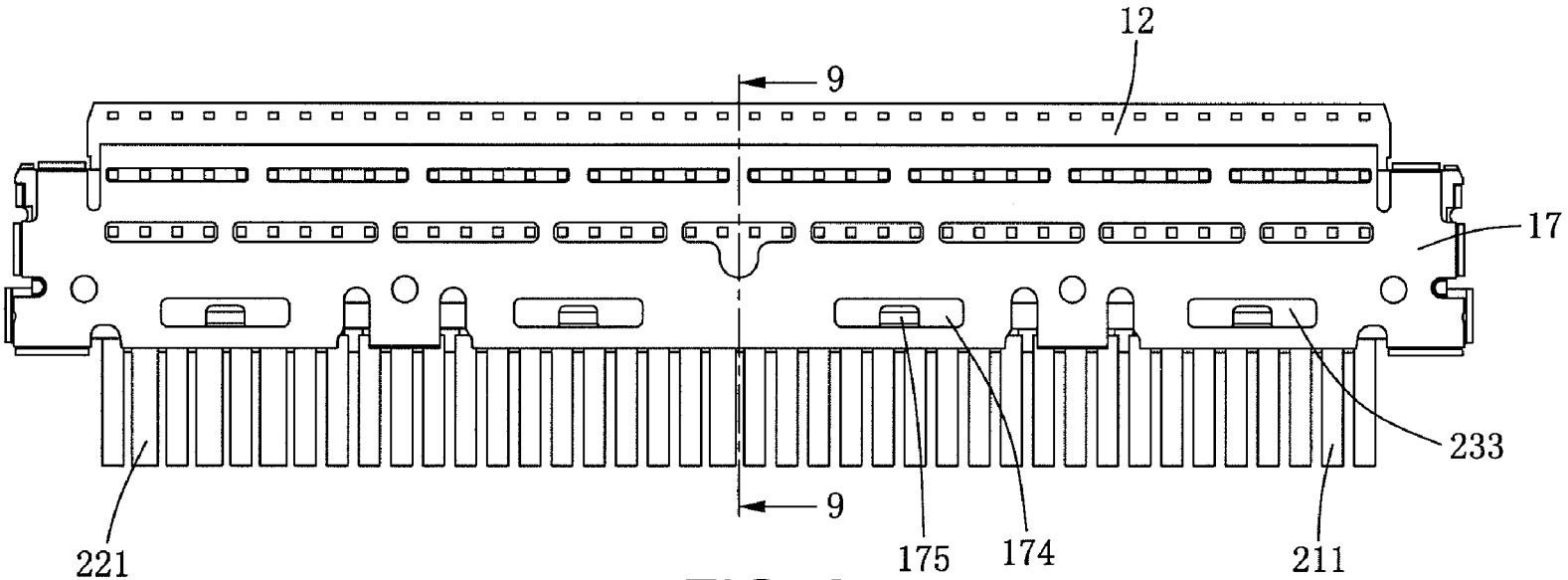
FIG. 8 a bottom view of the cable connector assembly shown in FIG. 5.
Figure 9:
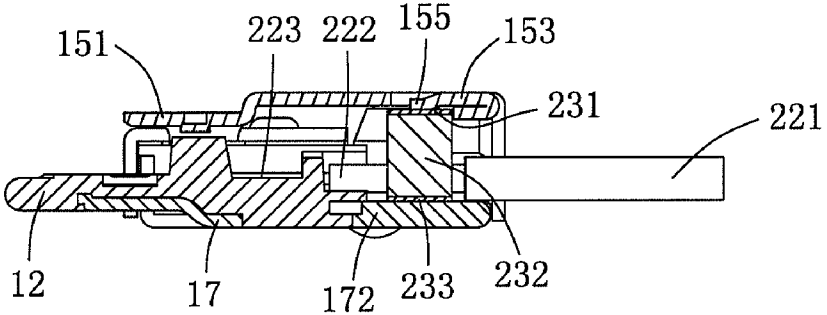
FIG. 9 is a cross-sectional view of the cable connector assembly taken along line 9-9 of FIG. 8.
Figure 20:
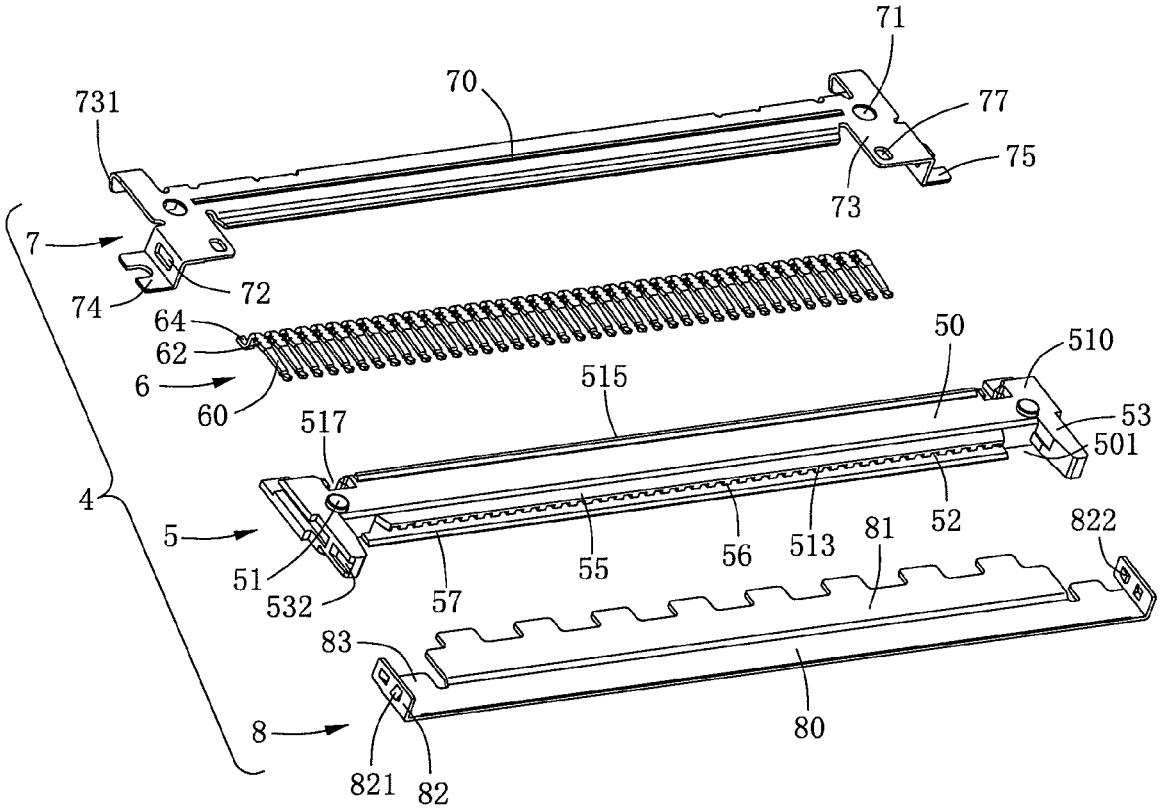
FIG. 20 is an exploded view of the female electrical connector shown in FIG. 15.
Figure 21:
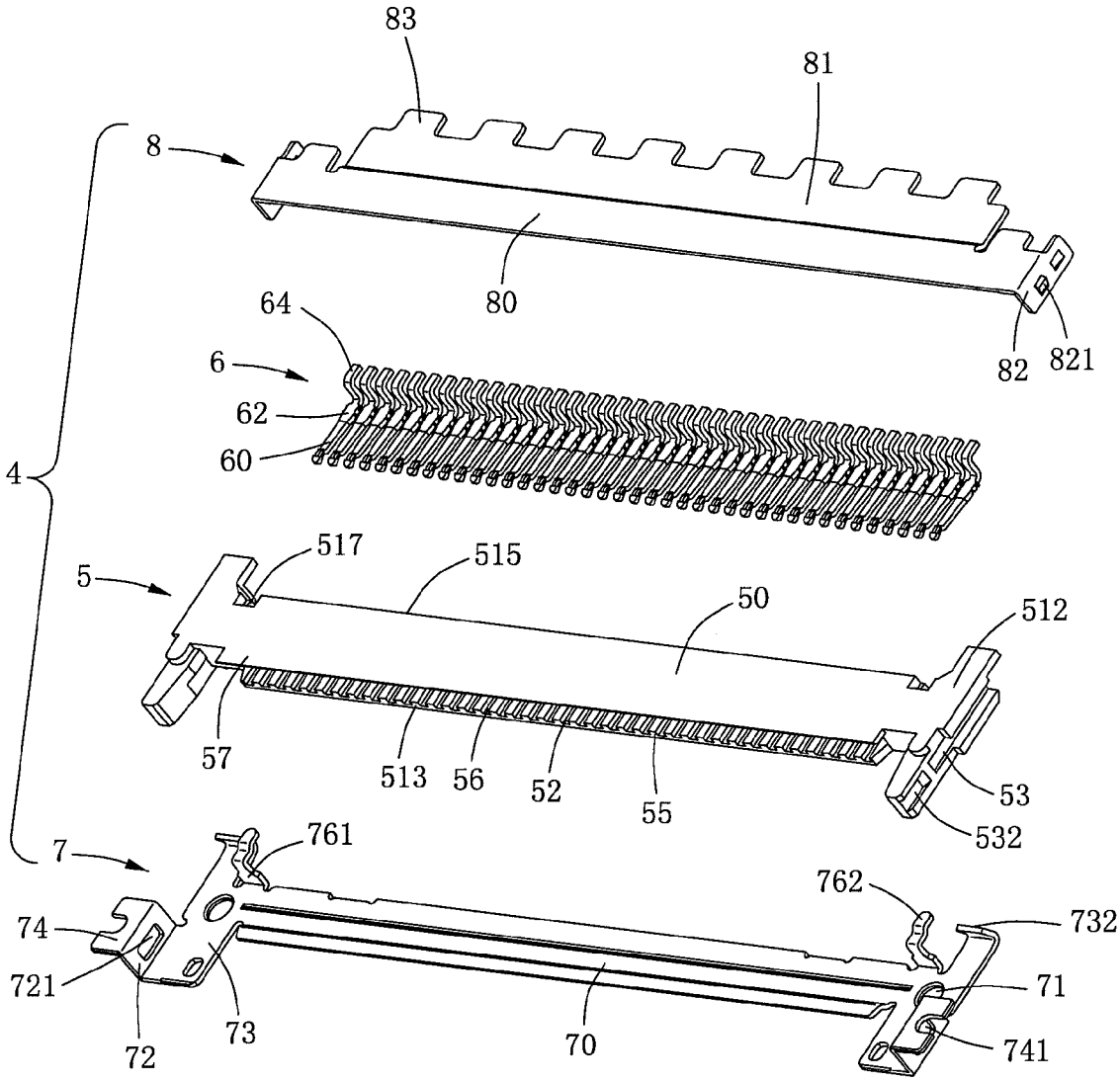
FIG. 21 is another exploded view of the female electrical connector show in FIG. 15, but viewed from another aspect.

Referring to FIGS. 6 and 20, a cable connector assembly 2 and a mated female electrical connector 4 for receiving the cable connector assembly 2 are disclosed according to a preferred embodiment of the present invention. The cable connector assembly 2 and the female electrical connector 4 will be detailedly described one by one.

Referring to FIGS. 1, 2, 6 and 9, the cable connector assembly 2 includes a cable connector 1 and a cable module 20 fixed in the cable connector 1. The cable connector includes an insulative housing 10, a plurality of first contacts 14 retained in the insulative housing 10 and an upper and a lower metal shells 15, 17 attached to the insulative housing 10. As shown in FIG. 6, the cable module 20 includes a grounding bar 23 and a plurality of wires 21, 22 with different cross sections soldered with the grounding bar 23. In assembly, the wires 21, 22 are arranged to extend through the grounding bar 23 along a front-to-rear direction to be soldered to the first contacts 14. Besides, grounding layers of the wires 21, 22 electrically connect with the grounding bar 23 which further abuts against the upper metal shell 15 in order to form a relative larger grounding path for EMI protection.

Figure 1:
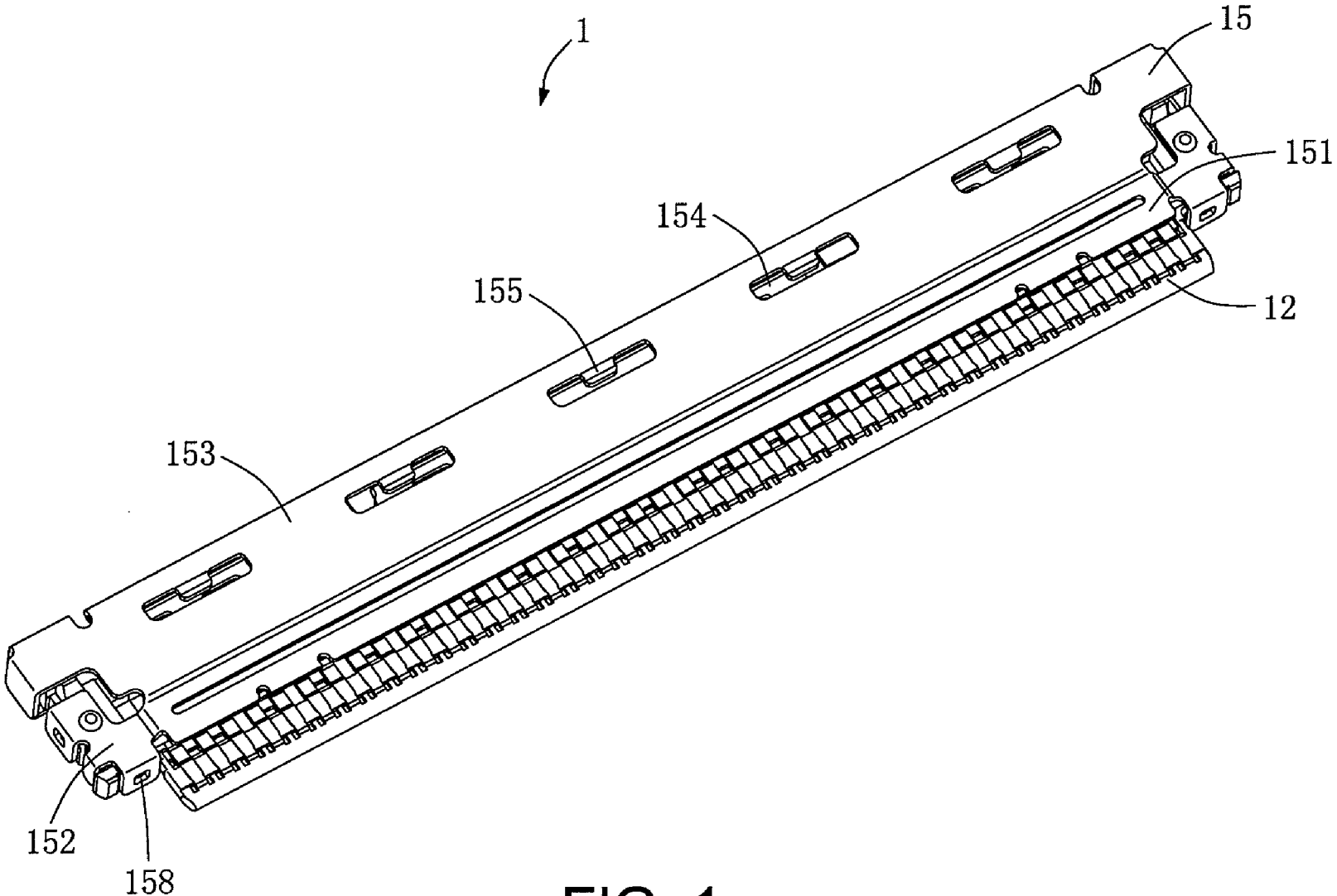
FIG. 1 is a perspective view of a cable connector according to a preferred embodiment of the present invention.
Figure 2:
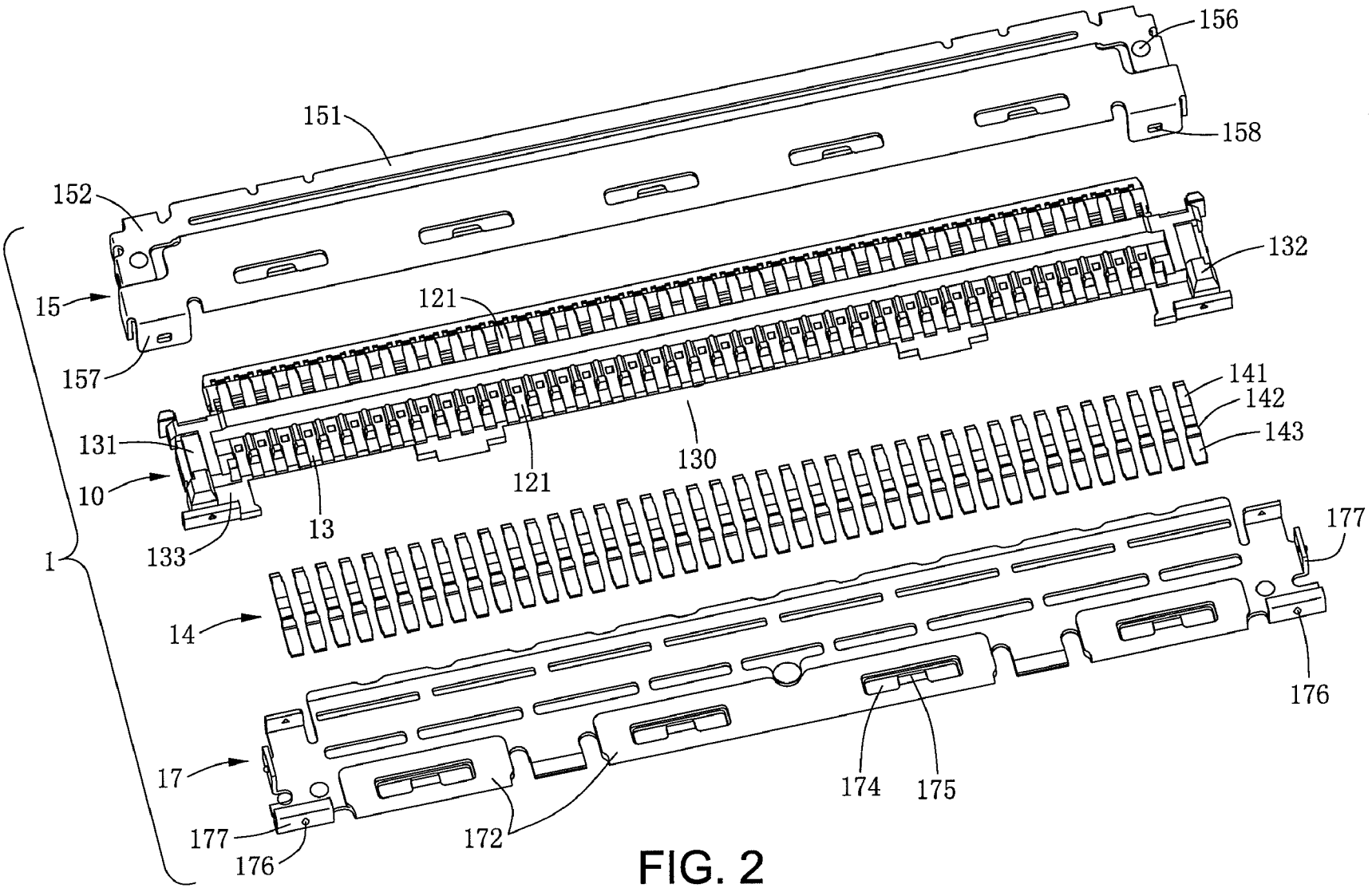
FIG. 2 is an exploded view of the cable connector shown in FIG. 1.
Figure 3:
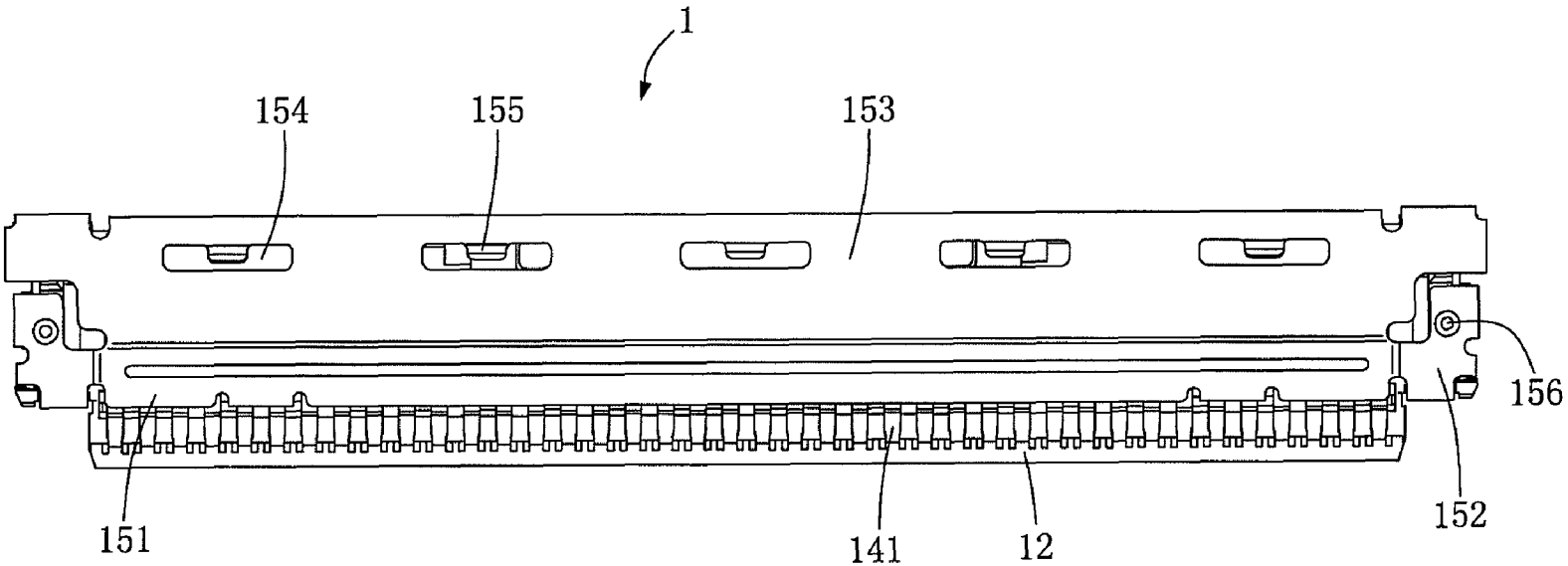
FIG. 3 is a schematic top view of the cable connector shown in FIG. 1.
Figure 11:
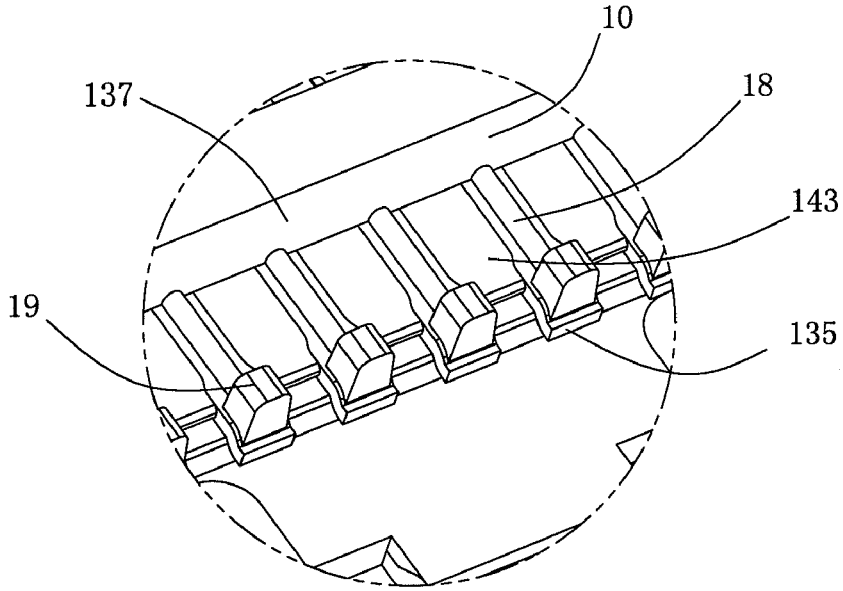
FIG. 11 is an enlarged view of portion B shown in FIG. 10.
Figure 12:
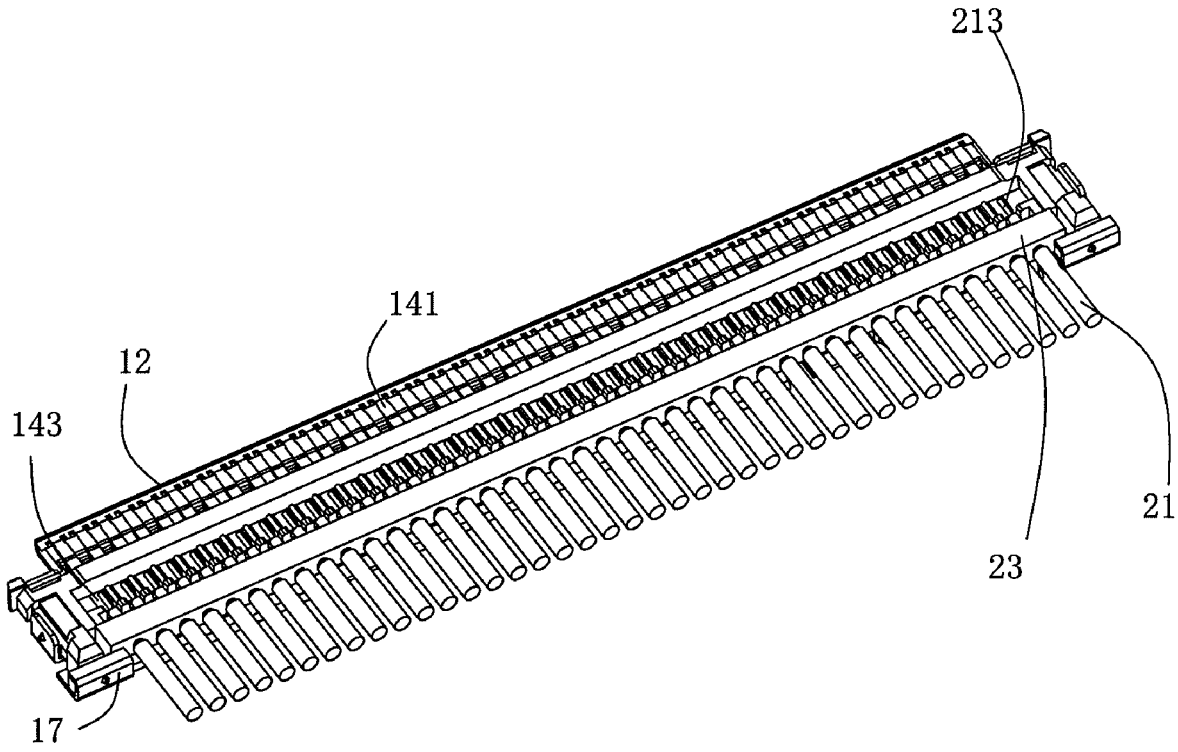
FIG. 12 is a part assembled view of a cable connector assembly with another cable module mounted on the cable connector shown in FIG. 10.
Figure 13:
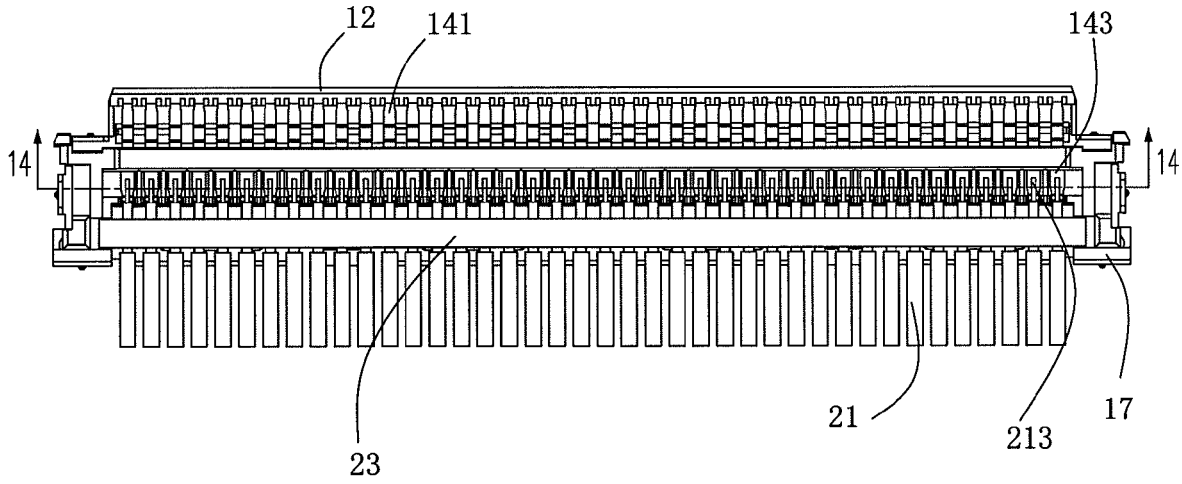
FIG. 13 is a top view of the cable connector assembly shown in FIG. 12.
Figure 14:
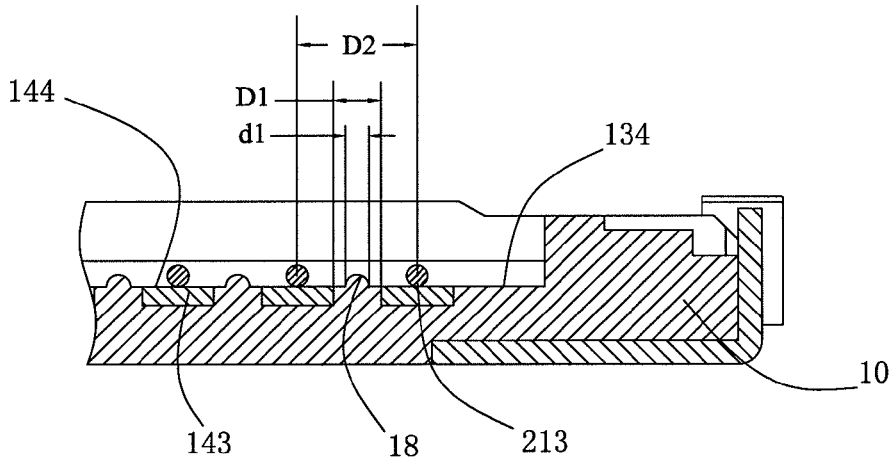
FIG. 14 is a schematic cross-sectional view of the cable connector assembly taken along line 14-14 of FIG. 13.

Referring to FIGS. 2, 11 and 14, the insulative housing 10 is formed of insulative materials such as plastic and includes a rear base portion 13, a contracted mating portion 12 extending forwardly from the base portion 13 and a pair of side protrusions 131 located at opposite sides of the base portion 13. Both of the base portion 13 and the mating portion 12 extend along a transverse direction perpendicular to the front-to-rear direction. A plurality of first passageways 121 are defined through the base portion 13 and the mating portion 12 for receiving the first contacts 14. The base portion 13 defines an upper mounting chamber 130 to form a rear surface 137 and a bottom surface 134 (shown in FIG. 14) positioned at the bottom of the mounting chamber 130. The mounting chamber 130 is located between the side protrusions 131 and is upwardly and forwardly exposed to the outside. The rear surface 137 is mainly located at a vertical plane and the bottom surface 134 is mainly located at a horizontal plane perpendicular to the rear surface 137. A plurality of ribs 18 are integratedly formed on the bottom surface 134 and extend upwardly beyond the bottom surface 134. The ribs 18 are arranged in rows along the transverse direction wherein each rib 18 extends along a longitudinal direction parallel to the front-to-rear direction under a condition that the rib 18 continuously extends backwardly to terminate at the rear surface 137. The base portion 13 includes an end surface 135 opposite to the rear surface 137 and a plurality of protrusions 19 integratedly formed at the back of the ribs 18 adjacent to the end surface 135. Each protrusion 19 connects with the corresponding rib 18 which is located at the front of the protrusion 19 under an arrangement that the protrusion 19 is aligned with the such rib 18 along the longitudinal direction. Each protrusion 19 is much wider and higher than its front rib 18 for positioning the wires 21, 22. Each side protrusion 131 includes a tower 132 protruding upwardly for supporting the upper metal shell 15, and a depression 133 communicating with the mounting chamber 130 for jointly receiving the cable module 20.

The first contacts 14 are stamped from a metal sheet and each includes a contact portion 141 disposed on the mating portion 12, a fixing portion 142 retained in the insulative housing 10 and a soldering tail 143 disposed in the mounting chamber 130. The soldering tail 143 defines an upper surface 144 exposed to the mounting chamber 130. When the first contacts 14 are assembled to the first passageways 121 along a rear-to-front direction, the first contacts 14 are guided by the protrusions 19. The upper surface 144 is coplanar with the bottom surface 134 and each rib 18 is located between the adjacent two soldering tails 143.

Figure 4:
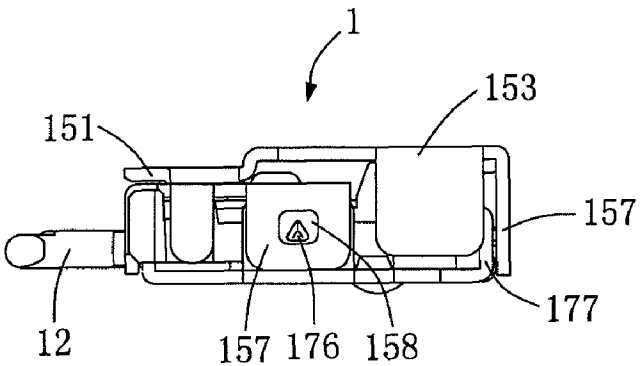
FIG. 4 is a left side view of the cable connector shown in FIG. 1, while with two times enlargement.
Figure 5:
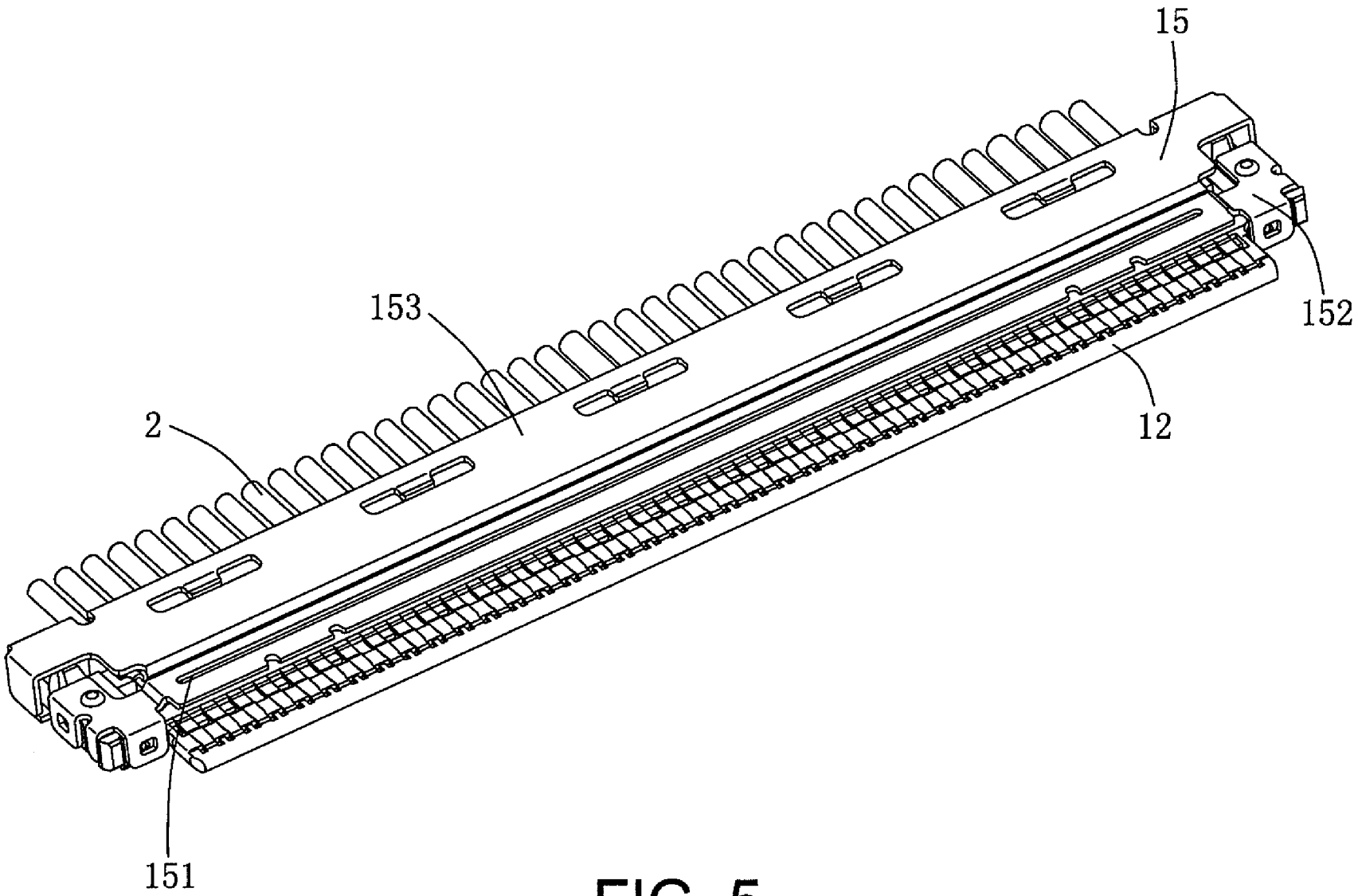
FIG. 5 is a cable connector assembly showing a cable module assembled into the cable connector.

Referring to FIGS. 1 to 4, the upper metal shell 15 is plate shaped and is stamped from an integral metal sheet. The upper metal shell 15 includes a flat mating section 151 adjacent to the mating portion 12 of the insulative housing 10, and an elevated rear section 153 covering the upper side of the mounting chamber 130. As shown in FIG. 4, the mating section 151 and the rear section 153 are arranged in step configuration from a side view. That is to say, the rear section 153 upwardly extends beyond the mating section 151 in order to form a relative larger mounting chamber 130 for accommodating the cable module 20. The mating section 151 includes a pair of abutting portions 152 located at opposite sides thereof wherein each abutting portion includes a projection 156 for resisting against the corresponding metal shield of the female electrical connector 4 in order to establish excellent shielding function. The rear section 153 includes a bending section 157 extending downwardly wherein the bending section 157 defines a through hole 158 for engaging with the lower metal shell 17. Besides, the rear section 153 includes a plurality of transverse slot 154 and a plurality of spring fingers 155 residing in the corresponding slot 154 and further protruding into the mounting chamber 130.

Figure 10:
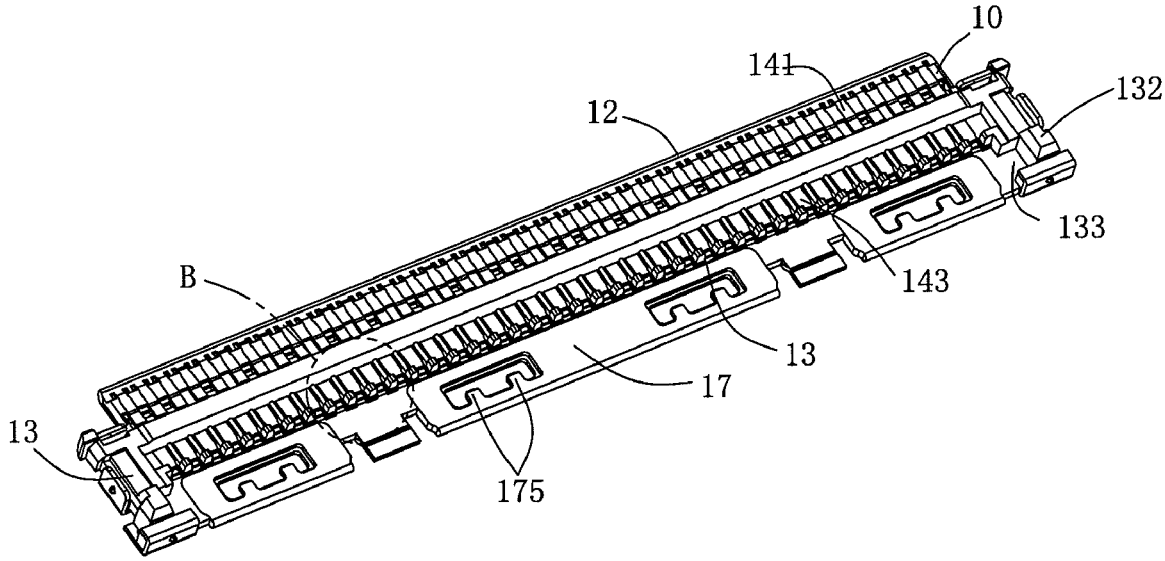
FIG. 10 is a perspective view of a cable connector with an upper shell removed therefrom according to a second preferred embodiment of the present invention.

The lower metal shell 17 is plate shaped and stamped from an integral metal sheet. The lower metal shell 17 includes a main body covering the lower side of the mounting chamber 130 and a plurality of extensions 172 bending forwardly from a rear edge 171 of the main body to further protrude into the mounting chamber 130. Each extension 172 includes a through hole 174 and a single spring 175 residing in the through hole 174. However, each through 174 can be provided with multiple springs 175 residing therein in order to achieve excellent elasticity as shown in FIG. 10. The main body includes a pair of bending portions 177 extending upwardly from lateral sides of the main body. Each bending portion 177 defines an extrusion 176 adapted for being received in the corresponding through hole 158 of the upper metal shell 15 so that the upper and the lower metal shells 15, 17 can be stably combined together.

Referring to FIGS. 5-14, the cable module 20 includes a grounding bar 23 and a plurality of wires 21, 22 soldered with the grounding bar 23. Each thin wire 21 is so-called micro coaxial wire and is composed of a jacket 211 at the outmost thereof, a grounding layer 212 formed below the jacket 211, an insulative layer (not shown) formed below the grounding layer 212, and a conductive core 213 at the innermost thereof. Each thick wire 22 is similar to the thin wire 21 and is composed of a jacket 221 at the outmost thereof, a grounding layer 222 formed below the jacket 221, an insulative layer (not shown) formed below the grounding layer 222, and a conductive core 223 at the innermost thereof.

The grounding bar 23 includes a top grounding plate 231 and a bottom grounding plate 233. In assembly, soldering tin is attached on inner sides of the top and the bottom grounding plates 231, 233 under a condition that the grounding layers 212, 222 of the wires 21, 22 are located between the soldering tin. Then, the soldering tin melts by application of heat to jointly combine with the grounding layers 212, 222 and forms a tin layer 232 between the top and the bottom grounding plates 231, 233. As a result, the wires 21, 22 can be fixed to the grounding bar 23. Electrical connection is established between the grounding layers 212, 222 and the top and the bottom grounding plates 231, 233 via such soldering tin. However, as shown in FIGS. 6-8 and 12-14, the wires 21, 22 can alternative be formed of different cross sections or the same cross section determined by different usage.

The cable module 20 is assembled into the mounting chamber 130 with the grounding bar 23 received in the depression 133 of the insulative housing 10. The jackets 211, 221 of the wires 21, 22 are positioned between adjacent protrusions 19 of the insulative housing 10. The conductive cores 213, 223 of the wires 21, 22 extend to the upper surface 144 of the soldering tails 143. The upper surfaces 144 of the soldering tails 143 are preliminarily attached with soldering tin which supports the conductive cores 213, 223. Each adjacent two soldering tails 143 are separated by the corresponding rib 18. As shown in FIG. 14, a space D1 between adjacent edges of the adjacent two soldering tails 143 is much bigger than a width d1 of the middle rib 18 which is located between the adjacent two soldering tails 143. A center space D2 between the adjacent two soldering tails 143 is bigger than D1. In soldering process, the soldering tin is heated to melt and diffuse so that the conductive cores 213, 223 are soldered with the corresponding soldering tails 143. Since the space D1 is much bigger than d1, a relative wider space can be provided for diffusion of the soldering tin to prevent mixture of the adjacent two soldering tails 143. Besides, the ribs 18 located between the adjacent two soldering tails 143 also can prevent the diffuse soldering tin getting over the ribs 18. As a result, short circuit of the adjacent two soldering tails 143 can be avoided.

In the preferred embodiment the space D1 is 0.2 millimeter and D2 is 0.5 millimeter. However, in other embodiments, the dimensions of D1 and D2 can be of some changes according to the dimension of space d1. For example, when D1 is 0.6 millimeter and d1 is 0.4 millimeter, the space D2 can be set of 1.0 millimeter; or when D1 is 0.4 millimeter and d1 is 0.3 millimeter, the space D2 can be set of 0.7 millimeter; or when D1 is 0.2 millimeter and d1 is 0.2 millimeter, the space D2 can be set of 0.4 millimeter, etc. Whatever, the dimension of D2 is no larger than 1.0 millimeter and the dimension D1 is no larger than 0.6.

Referring to FIGS. 15-21, the female electrical connector 4 is adapted for being mounted on a PCB and includes an insulative housing 5, a plurality of second contacts 6 retained in the insulative housing 5 and separated upper and lower metal shields 7, 8 attached to the insulative housing 5.

Referring to FIGS. 15, 16, 20 & 21, the insulative housing 5 includes a base 50, a pair of extending arms 53 protruding forwardly from opposite sides of the base 50 and a receiving space between the extending arms 53. The base 50 defines a top wall 510, a bottom wall 512, a front wall 513 and a rear wall 515. An upper plate 55 and a lower plate 57 are formed on the base 50 with a slit 56 formed therebetween. An inner side of the upper plate 55 defines a plurality of second passageways 52 communicating with the receiving space. The top wall 510 includes a pair of positioning protrusions 51 extending upwardly. A pair of openings 501 are formed between each extending arm 53 and the lower plate 57 as shown in FIG. 20. Each extending arm 53 defines a guiding slot 532 formed on its out surface thereof wherein the guiding slot 532 further extending forwardly through a tip thereof. A pair of mounting slits 517 are defined in the lateral sides of the rear wall 515.

The second contacts 6 are assembled to the second passageways 52 from the rear wall 515 of the insulative housing 5. Each second contact 6 includes a mating portion 60 exposed to the slit 56, a retaining portion 62 fixed in the base 50 and a soldering portion 64 extending beyond the rear wall 515 for being soldered to the PCB.

The upper metal shield 7 includes an upper main portion 70 attached to the base 50 and a pair of upper side portions 73 located at lateral sides of the base 50. Each upper side portion 73 includes a L-shaped bending portion 75 which includes a vertical portion 72 and a horizontal portion 74 perpendicular with each other. The vertical portion 72 defines a longitudinal engaging hole 721 along the front-to-rear direction. The horizontal portion 74 defines a semicircle cutout 741 through an out edge thereof. The semicircle cutout 741 can accommodate more soldering tin for being stably soldered to the PCB. Each upper side portion 73 includes a slant hook 732 bending rearwardly and downwardly therefrom. The upper main portion 70 defines a pair of first holes 71 for receiving the positioning protrusions 51 so that the upper main portion 70 can be fixed to the base 50. A pair of second holes 77 are formed at the front of the corresponding first holes 71 for abutting against the cable connector assembly 2. The upper main portion 70 further includes a pair of additional soldering springs 76 each of which includes a vertical section 761 received in the mounting slits 517 and a mounting tab 762 parallel to the soldering portions 64 of the second contacts 6.

The lower metal shield 8 include a lower main portion 80 and a pair of engaging portions 82 bending upwardly from lateral sides of the lower main portion 80. The lower main portion 80 includes an extension 81 extending backwardly therefrom and a pair of mounting plates 83 located at opposite sides of the extension 81. The pair of mounting plates 83 are located at the front of the extension 81. Each engaging portion 82 includes a tab 821 extending outwardly and a projection 822 extending inwardly under a condition that the tab 821 and the projection 822 are stamped along opposite directions of the engaging portion 82.

Figure 15:
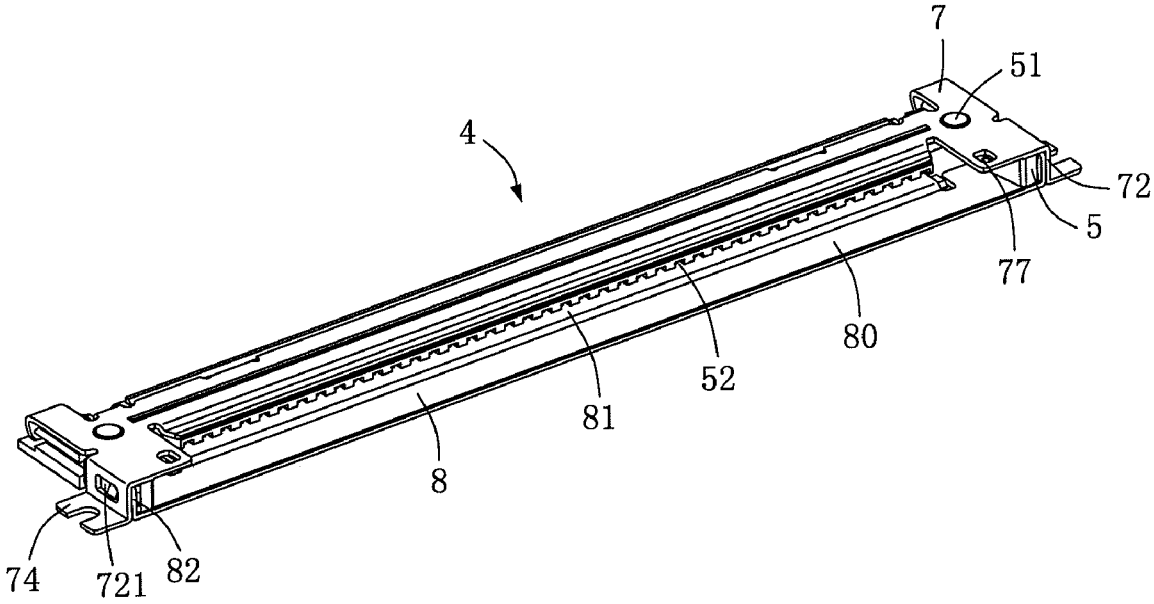
FIG. 15 is a perspective view of a female electrical connector for mating with the cable connector assembly shown in FIG. 5 or FIG. 12.
Figure 16:
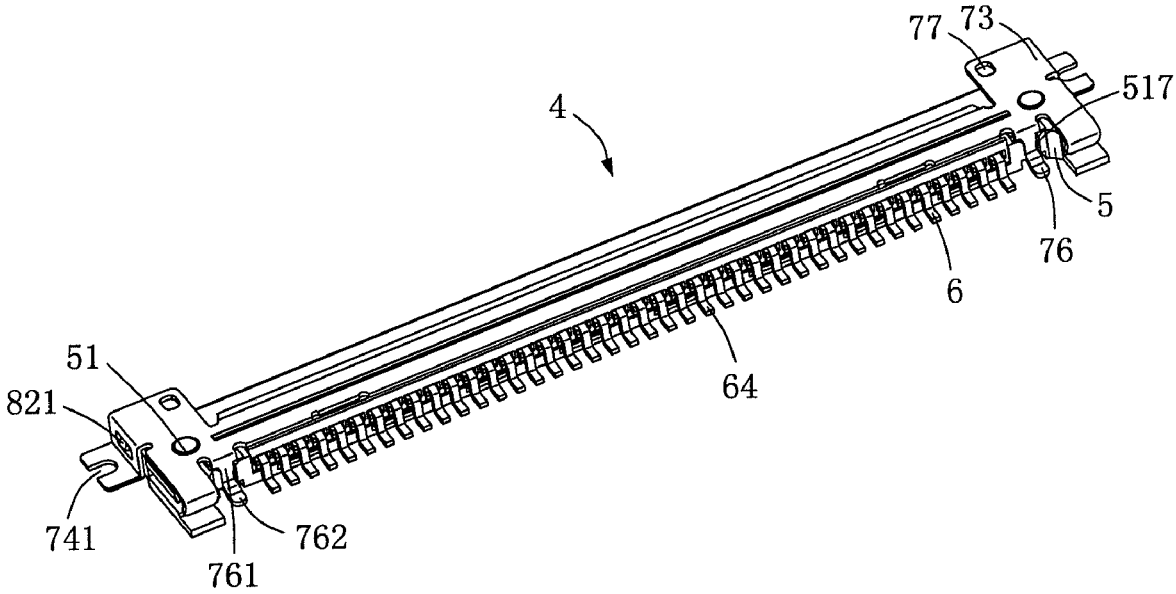
FIG. 16 is another perspective of the female electrical connector, while taken from another aspect.
Figure 17:
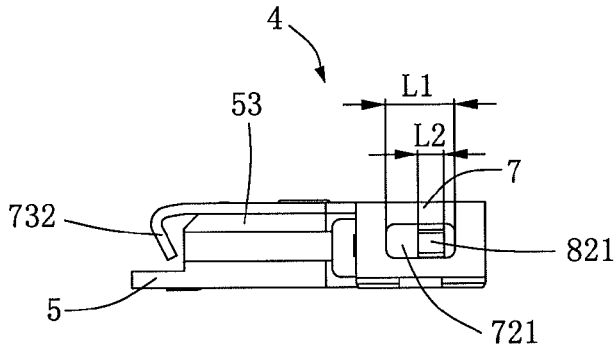
FIG. 17 is a right side view of the female electrical connector shown in FIG. 15, while with two times enlargement.
Figure 18:
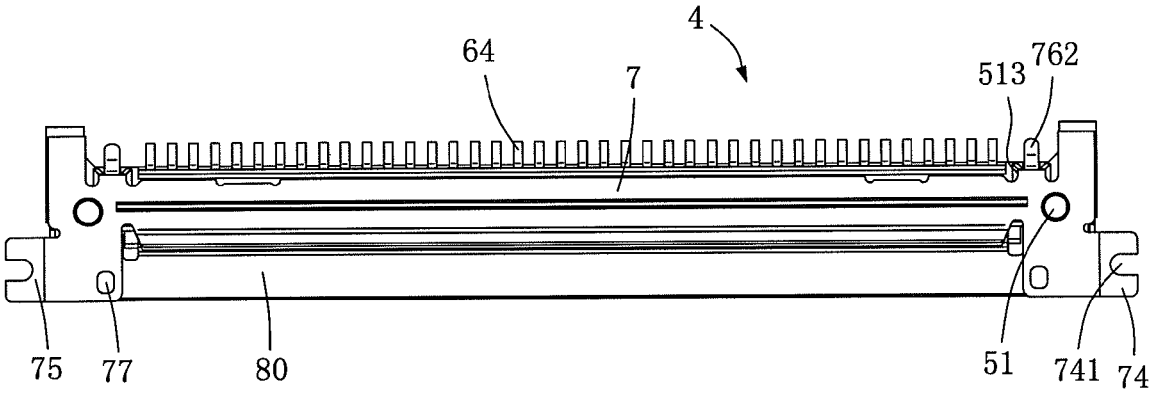
FIG. 18 is a top view of the female electrical connector shown in FIG. 15.
Figure 19:
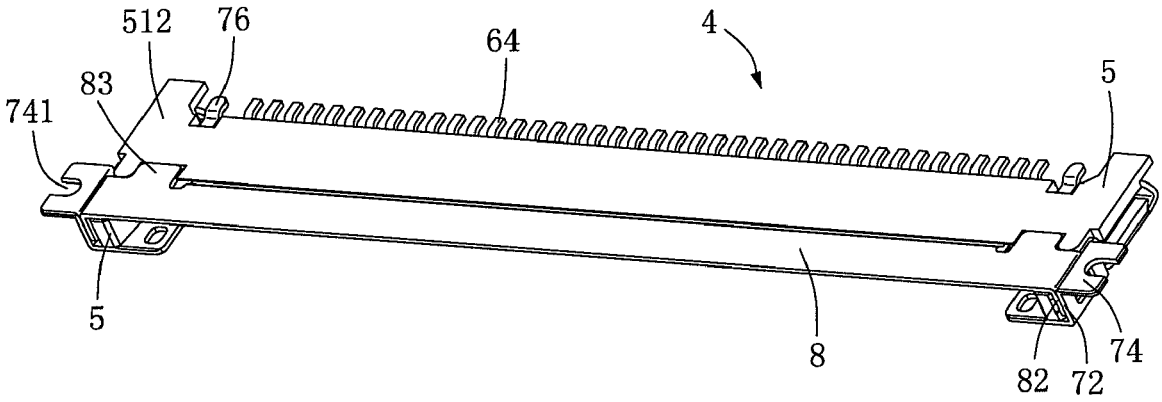
FIG. 19 is a bottom perspective view of the female electrical connector for better illustrating a bottom side thereof.

In assembly, the lower metal shield 8 is attached to the insulative housing 5 with the extension 81 received in the slit 56. The mounting plates 83 are received in the openings 501 for positioning. The projections 822 protrude into the guiding slot 532 and abut against the guiding slot 532. The pair of engaging portions 82 are attached to the out walls of the extending arms 53 as shown in FIG. 15. Then, the upper metal shield 7 is assembled to the insulative housing 5 with the L-shaped bending portions 75 lapping over the corresponding engaging portion 82. As shown in FIG. 17, a length L1 of the engaging hole 721 along the front-to-rear direction is much larger than a corresponding length L2 of the tab 821 so that the tab 821 can be easily inserted into the engaging hole 721.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly comprising:

a cable connector and a wire module fixed in the cable connector, the cable connector comprising:

an insulative housing having a rear base portion, a mating portion extending forwardly from the base portion and a plurality of passageways extending through the base portion and the mating portion, the base portion defining a mounting chamber, a bottom surface positioned at the bottom of mounting chamber and a plurality of longitudinal ribs formed on the bottom surface while extending upwardly beyond the bottom surface; and a plurality of contacts retained in the passageways, each contact comprising a contact portion disposed on the mating portion and a soldering tail disposed on the base portion under a condition that each adjacent two soldering tails are separated by one of the ribs along a transverse direction;

the wire module comprising:

a grounding bar received in the mounting chamber; and a plurality of wires fixed in the grounding bar and comprising central conductive cores protruding forwardly beyond the grounding bar to electrically connect with the soldering tails for signal transmission; wherein the longitudinal ribs are provided for preventing short circuit of the soldering tails when the soldering tails are soldered with the corresponding conductive cores; and wherein a space between adjacent edges of the adjacent two soldering tails is much bigger than a width of the corresponding rib which is located between the adjacent two soldering tails; wherein the base portion comprises a plurality of protrusions aligning with the corresponding ribs under a condition that each protrusion is much higher and wider than the rib which connects with the protrusion.

2. The cable connector assembly according to claim 1, wherein each soldering tail defines an upper surface exposed to the mounting chamber and coplanar with the bottom surface of the insulative housing.

3. The cable connector assembly according to claim 1, wherein each wire comprises an out insulative layer and a grounding layer inside the insulative layer, the insulative layer being clamped by the adjacent two protrusions for positioning, the grounding layer being soldered with the grounding bar, the central conductive core being formed inside the grounding layer.

4. The cable connector assembly according to claim 1, wherein the base portion comprises a rear surface backwardly exposed to the mounting chamber, the rear surface being perpendicular to the bottom surface, each rib continuously extending forwardly to connect with the rear surface and terminate at the rear surface.

5. The cable connector assembly according to claim 1, wherein the ribs are integrated with the bottom surface of the insulative housing.

6. The cable connector assembly according to claim 1, wherein a center space between the adjacent two soldering tails is no larger than 1.0 millimeter, and the space between the adjacent edges of the adjacent two soldering tails is no larger than 0.6 millimeter.

7. The cable connector assembly according to claim 1, further comprising a pair of separated upper and lower metal shells attached to opposite sides of the base portion to shield the mounting chamber, the upper metal shell comprising a flat mating section and an elevated rear section in step arrangement, the mounting chamber being upper open with the rear section located above the mounting chamber in order to enlarge the mounting chamber for easily receiving the grounding bar.

8. The cable connector assembly according to claim 7, wherein both of the upper and lower metal shells comprise a plurality of springs protruding into the mounting chamber, and wherein at least one spring formed on the upper metal shell abuts against the grounding bar for grounding purpose.

9. A cable connector comprising:

an insulative housing having a rear base portion, a contracted mating portion extending forwardly from the base portion and a plurality of passageways extending through the base portion and the mating portion, the base portion defining an upper mounting opening to form a rear surface and a bottom surface, a plurality of continuous ribs being integrated formed on the bottom surface and terminating at the rear surface under an arrangement that the ribs extend upwardly beyond the bottom surface; and a plurality of contacts retained in the passageways, each contact comprising a contact portion disposed on the mating portion and a soldering tail disposed on the base portion under a condition that each adjacent two soldering tails are separated by one of the ribs along a transverse direction; wherein a space between adjacent edges of the adjacent two soldering tails is much bigger than a width of the corresponding rib which is located between the adjacent two soldering tails; wherein the base portion comprises a plurality of protrusions aligning with the corresponding ribs under a condition that each protrusion is much higher and wider than the rib which connects with the protrusion; and wherein a space between the adjacent two protrusions is much smaller than that between the corresponding adjacent two ribs; and wherein a center space between the adjacent two soldering tails is no larger than 1.0 millimeter, and the space between the adjacent edges of the adjacent two soldering tails is no larger than 0.6 millimeter.

10. The cable connector according to claim 9, wherein each soldering tail defines an upper surface exposed to the mounting opening and coplanar with the bottom surface.

11. The cable connector according to claim 9, further comprising a pair of separated upper and lower metal shells attached to opposite sides of the base portion to shield the mounting opening, the upper metal shell comprising a flat mating section and an elevated rear section in step arrangement, the mounting opening being located above the mounting opening in order to enlarge the mounting opening for easily receiving a cable module.

12. The cable connector according to claim 11, wherein the base portion comprises a pair of towers with the mounting opening located therebetween, the towers supporting the rear section of the upper metal shell along a vertical direction.

13. A female electrical connector for being mounted on a PCB comprising:

an insulative housing having a base and a pair of extending arms protruding from the base with a receiving space formed between the extending arms, the base having an upper plate, a lower plate and a slit formed between the upper and the lower plates, the slit being in communication with the receiving space, an inner side of the upper plate defining a plurality of passageways opposite to the slit and further extending backwardly through a rear surface of the base;

a plurality of contacts retained in the passageways, each contact comprising a retaining portion fixed in the base, a mating portion exposed to the slit and a soldering portion extending backwardly beyond the rear surface of the base; and a pair of upper and lower separated metal shields attached to upper and lower sides of the base, the upper metal shield comprising an upper main portion attached to the base and a pair of upper side portions located at lateral sides of the base, each upper side portion comprises a L-shaped bending portion which includes a vertical portion and a horizontal portion under a condition that the vertical portion defining an engaging hole extending along a front-to-rear direction; the lower metal shield comprising a lower main portion and a pair of engaging portions bending upwardly from lateral sides of the lower main portion which is inserted into the slit and located at the bottom of the receiving space, each engaging portion comprising a tab extending outwardly; wherein the engaging portions are attached to out walls of the corresponding extending arms and the bending portions further lap over the engaging portions; and wherein a length of the engaging hole along the front-to-rear direction is much larger than a length of the tab so that the tab can be easily inserted into the engaging hole for locking the upper and the lower metal shields; wherein each extending arm defines a slit formed on an out wall thereof, and each engaging portion comprises a projection extending inwardly to abut against the slit.

14. The female electrical connector according to claim 13, wherein the tab and the projection formed on the same engaging portion are stamped from the engaging portion along opposite directions.

15. The female electrical connector according to claim 13, wherein the upper main portion defines a plurality of through holes and the base comprises a plurality of protrusions extending upwardly into the through holes.

16. The female electrical connector according to claim 13, wherein the horizontal portion defines a semicircle cutout through an out edge thereof for being soldered to the PCB.

* * * * *